United States Patent [19]

Chisholm et al.

[11] 4,331,521

[45] May 25, 1982

[54] NOVEL ELECTROLYTIC CELL AND METHOD

[75] Inventors: Raymond S. Chisholm, Pittsburgh, Pa.; Björn Holmström, Monte Carlo, Monaco

[73] Assignee: Oronzio deNora Impianti Elettrochimici S.p.A., Milan, Italy

[21] Appl. No.: 226,202

[22] Filed: Jan. 19, 1981

[51] Int. Cl.[3] ..... C25B 1/34; C25B 9/00; C25B 13/02; C25B 13/08

[52] U.S. Cl. ..... 204/98; 204/128; 204/266; 204/282; 204/283; 204/296

[58] Field of Search ..... 204/98, 128, 263, 266, 204/296, 282–283

[56] References Cited

U.S. PATENT DOCUMENTS 3,976,549 8/1976 Falvo ..... 204/98

4,166,014 8/1979 Sata et al. ..... 204/296

4,172,774 10/1979 Moeglich ..... 204/296

*Primary Examiner*—R. L. Andrews

*Attorney, Agent, or Firm*—Hammond & Littell, Weissenberger and Muserlian

[57] ABSTRACT

In an electrolytic cell comprising a cell unit with at least one anodic compartment equipped with an anode and at least one cathodic compartment equipped with a cathode, said compartments being separated by a diaphragm comprised of at least two separable layers of electrolyte impermeable, ion permeable material in contact with each other, the said layers being unbonded or weakly bonded together so they are capable of being separated or one of the layers having been at least partially preswelled before bonding and a method of electrolysis with said cells, especially for electrolysis of an aqueous electrolyte containing halide ions to produce halogen.

27 Claims, 2 Drawing Figures

NOVEL ELECTROLYTIC CELL AND METHOD

STATE OF THE ART

Figure 1:
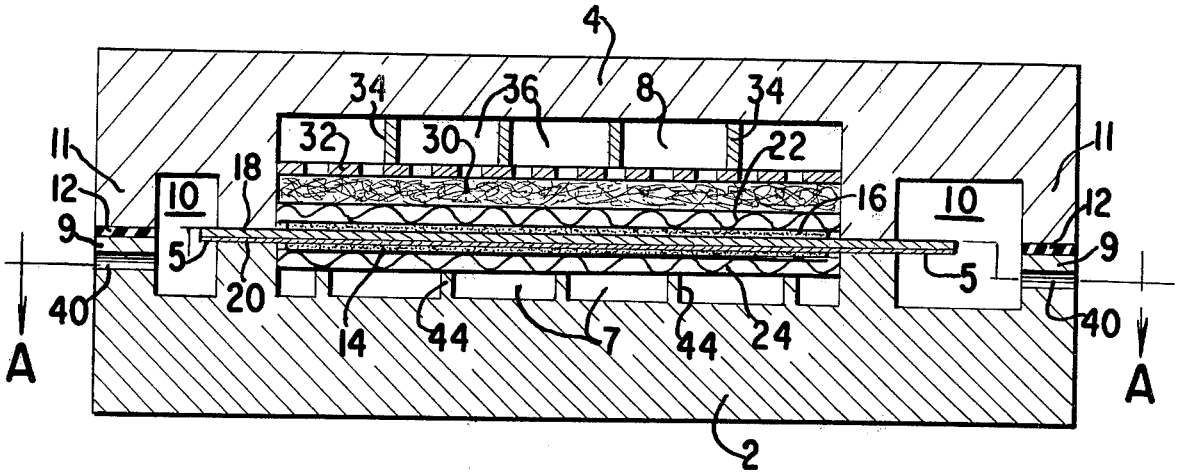

Electrolysis of aqueous alkali metal halides to produce halogen, especially chlorine, in an electrolysis cells provided with pairs of an anode and a cathode separated by an ion permeable diaphragm is well known and in some of the said cells, the electrodes are bonded to and/or embedded in opposite sides of the diaphragm which is usually a cation exchange fluorocarbon polymer.

In the later embodiment, the electrodes generally are comprised of electroconductive particles of a platinum group metal or oxide thereof bonded together and to the diaphragm by a polymer of trifluoroethylene or tetrafluoroethylene. A preferred anode is comprised of a mixture of graphite and pulverulent ruthenium oxide bonded with the fluorocarbon polymer in the form of a layer which is pressed against the ion exchange membrane and bonded thereto. A preferred cathode is comprised of platinum black powder optionally admixed with graphite bonded together with a fluorocarbon polymer in the form of a layer which is pressed against and bonded to the opposite side of the diaphragm or membrane. At least some of the bonded particles which project from the layer are partially embedded in the polymer.

The resulting membrane-electrode assembly is mounted in an electrolyte cell to which a substantially saturated aqueous alkali metal halide solution is fed into the anode chamber and water or dilute caustic is fed into the cathode chamber. By establishing an electrical potential between the anode and cathode with individual current distributors in contact with each electrode, chlorine is evolved at the anode and hydrogen and alkali metal hydroxide or carbonate are produced at the cathode. Electrolysis of this type may be conducted at high current densities, on the order of 1,000 to 5,200 amperes per square meter to anode surface and at a voltage which is several hundred millivolts lower than with unbonded electrodes.

Difficulties have been encounted in the prolonged operation of such cells because the cathode loses much of its effectiveness before the anode becomes inoperative. It is believed that the platinum black particles of the cathode are attacked by the alkaline catholyte and/or lose their adhesion to the membrane and are washed away. In any event, the layer ceases to function sufficiently as a cathode and the cathode current distributor becomes the cathode partly or completely.

Furthermore, some difficulty has been encountered in achieving optimum current efficiency with certain types of membranes and thus it has been proposed to make use of membranes which predominately contain sulfonic acid groups or like groups of strong acid on one side, notably the side facing the anode and predominately weaker acid groups i.e. carboxylic groups on the opposite side i.e. the cathode side of the membrane. This is described in East German Patent Application No. 93,990. Also, U.S. Pat. No. 4,224,121 of the General Electric Company describes a diaphragm in which the cathode side has a lower water content than does the anode side. In testing such unitary multilayer membranes, blisters have been noted to form within the membrane for reasons not yet fully understood but may be due to the fact that one side of the membrane tends to swell or expand more than the other side and thereby produces stress in the membrane. It may also be due to other causes.

OBJECTS OF THE INVENTION

It is an object of the invention to provide novel diaphragm cells provided with multi-layered membranes or ion-permeable diaphragms in which two layers are swelled by water or electrolyte and at least one of the layers having been at least partially preswelled or expanded independently of the other layer.

It is another object of the invention to provide a diaphragm cell provided with multi-layered membranes or diaphragms which are unbonded or only weakly bonded together so that they are capable of being separated for replacement of one of the layers.

It is a further object of the invention to provide an improved process for the electrolysis of aqueous halide solutions to produce halogens.

These and other objects and advantages of the invention will become obvious from the following detailed description.

THE INVENTION

The electrolytic cell of the invention is comprised of a cell unit with at least one anodic compartment equipped with an anode and at least one cathodic compartment equipped with a cathode, said compartments being separated by a diaphragm comprised of at least two separable layers of electrolyte impermeable, ion permeable material in contact with each other, the said layers being unbonded or weakly bonded together so they are capable of being separated or one of the layers having been at least partially preswelled before bonding.

The electrolytic cell is especially suitable for generating halogen by electrolyzing an aqueous halide and the cell has a multilayer diaphragm, the layers of which are swellable ion exchange polymers which are either unbonded to each other whereby they may contract or swell separately during equilibration or if bonded, at least one of the layers has been at least partially swelled by water or electrolyte before the bonding. Electrodes may be bonded to the outside surfaces of the multilayer diaphragm.

The unbonded layers of the diaphragm may be evacuated to prevent gas or liquid entrapment between them and the evacuated assembly is installed as a diaphragm in the cell with or without further evacuation before and/or during the electrolysis. Since the layers are unbonded, they are able to swell separately to at least some degree during preparation or use in the cell. The preswelled layers may be bonded together after swelling or they may be unbonded or only weakly bonded. In the latter case, they are readily separable during operation of the cell and if one layer or an electrode bonded thereto degenerates or breaks down faster than the other layer or electrode, the layer may be replaced individually with the other layer being retained in operation.

In one embodiment, a bilayer diaphragm comprising one layer of a fluorocarbon ion exchange polymer having sulfonic acid groups and a second polymer layer having carboxylic groups may be prepared by preswelling one of these layers e.g. the sulfonic layer by soaking in electrolyte or by conditioning in an atmosphere of steam or air of controlled humidity. The other may be unswelled or conditioned or separately swelled to a different degree by soaking or humidification and the two layers are then bonded together by heat and/or pressure or an adhesive such as a solution of ion exchange polymer. While the degree of difference in swelling may be small, this difference aids in compensating for differences between the two layers in swelling or expanding in the course of preparation for use in the cell and/or during electrolysis.

In the embodiment in which the layers may be unbonded to each other, the separate layers are installed between permeable electrodes or current collectors and pressed tightly together during cell operation, preferably after gas and liquid have been evacuated from between the layers. The layers may be coated with or have bonded thereto (on their outer sides only) gas and electrolyte permeable electrodes and are assembled so that each electrode may be oppositely polarized during the electrolysis. In this case, if one layer or the electrode thereon should degrade or break down before the other layer or if the electrode layer does so, the one layer of membrane may be separated without damaging the other layer. Therefore, it may be replaced with a new electrode layer or a restored layer and this new restored layer is then assembled with the undegraded electrode layer for continued electrolysis. Obviously, this reduces the overall cost of diaphragm or electrode in those cases where one of the layers or one of the electrodes thereon has a greater durability or life than does the other layer or electrode.

Normally, the separate layers are pretreated or preswelled by boiling in water or aqueous alkali solutions or other techniques normally used to precondition such membranes and are then installed in the cell ready for electrolysis in an unbonded state. These layers are pressed together during electrolysis and, if necessary, the space between them is evacuated so that close contact between the layers is ensured. In the course of their use, some adhesion between the layers may develop but the layers are free to swell i.e. change respective dimensions separately so that if one layer tends to swell more than the other, each may expand independently of the other. Thus, strains which might tend to develop when layers of a membrane are bonded together before preconditioning is at least partially avoided or minimized. Furthermore, unless the sheets or layers are deliberately bonded together, they can be separated without damage so that one can continue in use while the other can be replaced or separately restored.

It is also important to recognize that the degree that a membrane expands is influenced by the electrolyte with which it is in contact. For example, a carboxylic acid membrane will expand to a lower degree when in contact with high sodium hydroxide concentrations, e.g. 40 to 45%, than at lower concentrations. Thus, expansion may vary even during operation if the alkali metal hydroxide concentration changes and such changes can be accommodated if the layers are not bonded together.

In another embodiment, one or both of the layers may be separately swelled to the degree desired and then bonded together. For example, a fluorocarbon polymer having preponderantly sulfonic acid or phosphonic groups may be preconditioned by heating or boiling in water or sodium hydroxide solution or by retaining it in an atmosphere of controlled humidity until it has been swelled at least to some degree and has absorbed some water. It can then be assembled under pressure and bonded to a membrane layer of lower water content having preponderantly weaker acid groups or tending to have lower water content when used e.g. carboxylic acid groups. This bonding may be effected by heating under pressure as long as proper precautions are taken to avoid excessive water loss. For example, the assembled layers may be enclosed in a moisture tight envelope e.g. between two sheets of polyethylene film to retain the water in the one layer during heat and pressure lamination to bond the layers together. Alternately, the layers may be bonded together by applying a coating of a solution of a fluorocarbon polymer ion exchange resin.

If desired, the electrodes or one of them bonded to the outer sides of the respective layers may be omitted and in this case, screens or other perforate electrodes are pressed against each side of the multilayer membrane to serve as electrodes. If one layer then deteriorates before the other, the cell is taken apart, the deteriorated layer replaced and the cell reassembled with the new membrane layer held in contact with the older layer of greater durability.

To hold the layers in close contact with each other, the space or area between the layers is evacuated before or during installation in the cell and may even be evacuated during cell electrolysis operation. One convenient method of evacuation is to roll the prewetted layers together. Since the cation exchange sheets are often fluid tight, they may be laminated while wet and air and excess liquid squeezed out by passing them between rolls with the effective evacuation of the space between the layers. Liquid squeezed to the edges seal the edges and tend to preserve the evacuation. Other methods such as clamping or bonding edges and continued evacuation may be used to preserve this evacuated status.

Figure 2:
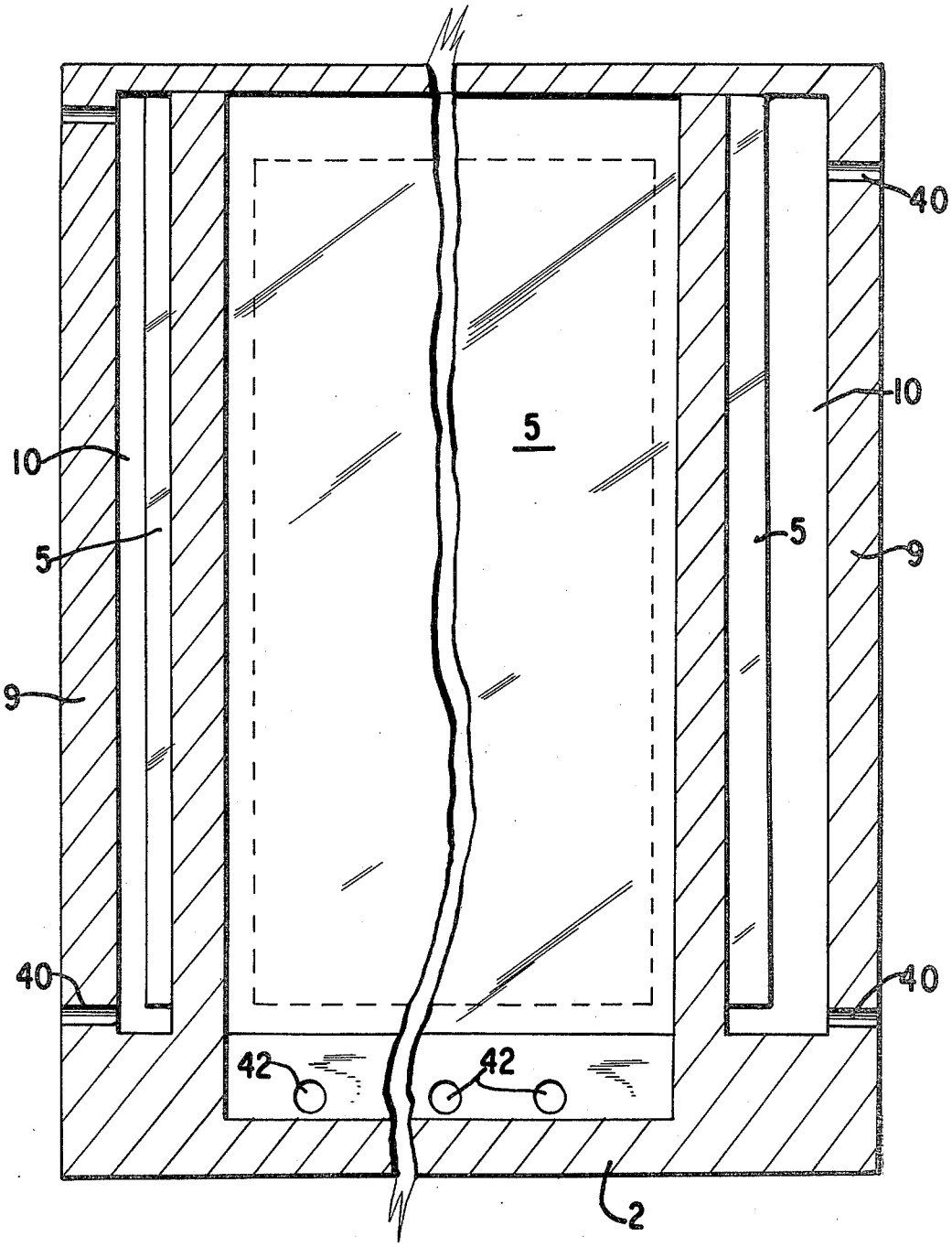

Accomplishment of the foregoing constitute some of the objects of the invention, others of which will be apparent by reference to the ensuring disclosure and the accompanying drawing in which:

FIG. 1 is a diagrammatic horizontal cross sectional view of one embodiment of the cell contemplated; and FIG. 2 is a vertical sectional view of the cell of FIG. 1 taken along line A—A which runs along the outer anode side of the membrane.

As shown in the Figs., the cell is comprised of vertical anode endplate 2 of a suitably resistant material such as titanium metal (or other valve metal) clad steel and a vertical cathode endplate 4 capable of resisting the cathodic corrosion of alkali such as steel, stainless steel or nickel. Each of these endplates has a central electrolyte channel providing respectively an anolyte channel 7 and a catholyte channel 8. The anode end wall has peripheral side walls 9 which enclose the central anode or anolyte channel and these walls are recessed to provide an outer channel on each side of the central anode chamber 7. The chamber end wall also has peripheral side walls which enclose the sides of the central cathode channel and are similarly recessed.

The multilayer diaphragm or membrane is disposed between the two endplates and the peripheral side walls of the endplates tightly butt against opposite edges or margins of the diaphragm to form a seal which is capable of retaining anolyte and catholyte in their respective compartments. The end walls are aligned so that the recessed portions in the side walls mate to provide the gas and fluid tight chamber 10 into which the edges of the diaphragm extend into communication therewith but only partially across the chamber 10. Gaskets 12 may be interposed between the walls to achieve the required seals and to isolate and seal the central anolyte and catholyte chambers from the outer or side chambers and to insulate the anode endplate from the cathode endplate. The endplates are compressed tightly together to make all joints fluid tight.

The diaphragm consists of two layers 18 and 20 which are in tight face-to-face contact with each other and generally, each of these layers are themselves imperforate and do not permit mass flow of electrolyte therethrough although water may be transferred to some extent, largely by dialysis. Also both are ion exchange materials, most often cation exchange materials but, the layers preferably differ in composition and for most purposes, the layer on the cathode side is more weakly acidic and absorbs less water than the layer on the anode side.

A gas and electrolyte permeable anode 14 is bonded to and/or imbedded in or dispersed in the outer side (the side remote from the other layer 18) of layer 20 and a gas and electrolyte permeable cathode 16 is bonded to and/or embedded in or dispersed in the catholyte or outer side of layer 18. Each of these electrodes is in the form of a thin layer, extending along the side of the diaphragm and the overall thickness of the diaphragm layers is small so that the spacing between electrodes is small, rarely being above 0.3 to 3 millimeters.

These electrodes may be produced or deposited on their respective layers in the manner normally resorted to in the art to provide such electrodes. For example, the cathode may comprise platinum black powder or another pulverulant platinum group metal or oxide thereof (with or without graphite powder) and bonded together with a fluorocarbon polymer such as a polymer of tetrafluoroethylene or trifluoroethylene. A layer of this material is pressed against one side of the diaphragm layer and bonded thereto by heat and pressure as described in U.S. Pat. No. 4,210,501 for example. In another method, the electrode may be deposited by an electroless plating process or by vapor deposition or cathode sputtering. In such cases, a thin metal coating, rarely above 0.5 to 5 millimeters in thickness, is deposited and the metal may be platinum, palladium or other platinum group metal but on the cathode side may be nickel or iron which may in turn be coated with platinum, iridium or other platinum group metal.

In any event, each layer is so coated only on its outer side and behind each electrode is a current distributor screen which bears and presses against the electrode. Thus, a thin, flexible screen 24 made of titanium or niobium which may be coated with platinum or like metal presses against the back or exposed side of the anode and distributes current thereto. In like manner, a thin pliable nickel or iron screen presses against the back or exposed side of the cathode and distributes current thereto. The fine mesh of the respective screens provides a plurality, e.g. 30 or more, of contacts per square centimeter with the electrode with which it is in contact. The anode screen, if desired, may be relatively rigid to transmit substantial pressure against the anode and the diaphragm and to resist bending in the spaces between anode ribs 44.

A wire electroconductive mat 30 presses against the cathode screen and this mat is formed of undulating open knitted metal wire and is resiliently compressible to distribute a more or less uniform pressure over the entire screen when it is compressed by movement of an electroconductive rigid perforate pressure plate 32. The pressure plate 32 is spaced from the cathode endplate to provide a rear chamber 36. On the chamber side, electroconductive ribs 34 extend from the cathode endplate across the space 36 and bear against the pressure plate 32. They may be welded to the plate to provide a suitable means for squeezing the mat and they supply current and polarity to the plate 32. Conductive anode ribs also extend across anode chamber 7 and support the anode screen 24. Recourse to such a compressible resilient mat is described and claimed in copending, commonly assigned U.S. Patent application Ser. No. 102,629 filed Dec. 11, 1979.

As will be apparent from FIG. 1, when the cathode and anode endplates are pressed together, the moveable cathode pressure plate 32 squeezes the mat and thereby presses the screens and the diaphragm layers tightly together. Thus the cell is tightly closed with the electrode screens and the diaphragm squeezed together under a firm pressure which is relatively uniform over the entire diaphragm surface.

The cell illustrated in FIG. 1 is especially designed for use of diaphragm layers which are not bonded together. In such an embodiment, it is important that the layers be held together tightly enough so that gas and/or water or electrolyte does not accumulate between the layers. Thus, means are provided to squeeze the layers together while leaving the membrane edges open so that entrapped gas or liquid may be squeezed out the edges. The diaphragm layers extend a short distance into the peripheral or edge chambers 10 and the pressure in chambers 10 is held low with respect to the pressure applied against the membrane. For example, the chambers 10 may be put under vacuum and in any event, the pressure in the cell anolyte and catholyte to the chambers is held well above that established in chambers 10. Consequently, liquid or gas which might tend initially to accumulate between the layers is effectively squeezed edgewise into chambers 10 and drained or drawn off through ports 40.

As shown in FIG. 2, the electrodes and current distributor screens are centrally disposed and may be (but not necessarily) somewhat spaced from the side walls as illustrated by the dotted lines. In all events, uniform pressure is maintained over the entire area of the enclosed diaphragm to prevent substantial liquid or gas accumulation therebetween. The cell is provided with means to feed anolyte into the bottom of the anolyte chamber through ports 42 and to flow anolyte upward to the top where evolved gas and electrolyte are withdrawn in a manner as described in the aforesaid U.S. application Ser. No. 102,629. The catholyte chamber is similarly provided with means (not shown) to circulate electrolyte therethrough and to withdraw alkali metal hydroxide solution and hydrogen.

In operation, the cell is assembled as indicated and the individual layers of membrane are pressed together to form the composite diaphragm. Often, the layers are preassembled and evacuated as described below. Chambers 10 are evacuated by pulling a vacuum thereon to remove any entrapped gas and liquid from between the layers and a saturated aqueous sodium chloride solution is fed into the anolyte chamber through ports 42. This solution rises along the anode and screen and escapes with evolved chlorine through ports not shown, is resaturated and recycled to the cell. An electrolyzing voltage is imposed between the electrodes to generate chlorine at the anode and at the cathode to generate hydrogen and aqueous sodium hydroxide. Water or dilute sodium hydroxide solution is circulated through the catholyte chamber and flows upward through the mat and along the screen and cathode and the evolved alkali metal hydroxide and hydrogen gas is withdrawn through the top of the cell as is well known in the art.

If desired, chambers 10 may be evacuated throughout the operation but this may be unnecessary after startup so long as a differential pressure is maintained between the pressure in the cell (anolyte and catholyte) and the chamber 10. Generally, the magnitude of this pressure difference does not need to exceed 50 to 1000 millimeters of mercury and in all events, the clamping pressure between the electrode screens should be maintained higher than this edgewise pressure difference so that little or no layer separation may occur. Any gas or liquid leaking into chambers 10 is withdrawn through one of the ports 40.

The process is continued from week to week or month to month and eventually one or the other of the electrodes or the layers deteriorates and the cell is disassembled. Where possible, only the coated layer which has the deteriorated electrode or is itself deteriorated is replaced with a new electrode coated layer and the cell is reassembled for further operation. If desired, the electrode coating on one or both of the layers is dispensed with and in that event, the current distributors 22 and 24 act as the electrodes. In that case, the screens are preferably relatively fine to provide 30 or more contacts per square centimeter and may be 20 to 100 mesh or finer.

A large group of ion exchange membranes suitable for use in the electrolysis of aqueous halide solutions is known to the art. Many of these are fluorocarbon polymers which contain cation exchange groups and are copolymers of tetrafluoroethylene with $CF_2{=}CF{-}O\,CF_2\,CF_2\,SO_3H$ or other corresponding acidic polymerisable fluorocarbon. These types of materials comprise long fluorocarbon chains with various acidic groups including sulfonic, phosphonic, sulfonamide or carboxylic groups or alkali metal salts of said groups attached thereto. These polymers are described in various patents and articles including the following U.S. Pat. Nos. 3,282,875, 3,784,399, 4,081,349, 4,025,405, 4,065,366, 4,178,218, 3,976,549, 4,151,053 and British Pat. Nos. 1,497,748, 1,184,321, 1,516,048, and 1,493,164 and other publications referred to in these patents. Ion exchange sheets of suitable fluorocarbon polymer are supplied by E. I. DuPont under the trade name "Nafion" and by Asahi Glass Company of Japan under the trade name "Flemion".

Unfluorinated ion exchange films or layers may be used on the cathode side as they are not subject to severe chlorination and these include polymers of chlorovinyl benzene and/or styrene with maleic anhydride or acrylic acid or an ester thereof which has been hydrolyzed after polymerization. They may also include copolymers of vinyl pyridine with styrene and/or divinyl benzene.

These ion exchanger membranes are in the form of thin, air impermeable sheet about 0.5 to 5 millimeters in thickness and are imperable to mass flow of electrolyte although some water may transfer during electrolysis. The membranes having predominately sulfonic or phosphonic groups are relatively strong acids and often absorb 25 to 30 percent by weight of water based upon the dry weight of the polymer. Those which contain predominately carboxylic acids are weaker acids and absorb less water and thus, they expand to a lesser degree when exposed to hot alkali metal hydroxide. The amount of acid groups in these exchange membranes varies but generally ranges from about 800 to 2000 in equivalent weight.

According to one embodiment, the membrane comprises one layer of a strong acid cation exchange material or one of high water absorption superimposed upon a layer of a weaker acid cation exchanger or one which has lower water absorption. To hold these two layers together, it is desirable to evacuate the space between them and this may be accomplished by wetting the sheets with water or an aqueous electrolyte such as alkali metal hydroxide or carbonate. The assembled laminate is then passed through rolls or is laid out on a flat surface and rolled to squeeze out air and liquid. Since the sheets themselves are relatively fluid tight, the vacuum thus established tends to be maintained by atmospheric pressure. If desired, the edges may be clamped or otherwise protected to prevent loss of evacuation while the diaphram is installed. Usually, the edge protection means may be removed after the diaphragm has been installed and just before the cell is finally clamped together.

Often, it is advantageous to precondition the layers before assembly and in that event, each layer may be heated while separate i.e., unbonded, in water or aqueous alkali metal hydroxide or halide to cause them to absorb water and expand to a substantial equilibrium. These sheets, while still wet and equilibrated, may be pressed together and rolled to squeeze out air and excess water to thereby evacuate them. This laminate, with temporary protection of edges if necessary to preserve loss of evacuation status, is installed in the cell. The edges may be protected temporarily by applying thereto a temporary water-soluble adhesive such as sugar syrup or the like so that the edges temporarily bond together after air has been squeezed out. This adhesive will tend to be washed out during cell operation.

When the layers are not bonded and are held together by the evacuation and/or the lateral pressure applied to the electrodes, any change in dimension due to swelling or contraction of a layer is readily accommodated because the layers are free to slide or move with respect to each other so no strain can be placed on one layer because of change in dimension of the other.

Typical laminated membranes include the following combinations:

| Layer on Cathode Side | Layer on Anode Side |
|---|---|
| Carboxylic acid | Carboxylic acid |
| Carboxylic acid | Sulfonic acid |
| Carboxylic acid | Phosphonic acid |
| Sulfonic acid | Sulfonic acid |
| Sulfonamide | Sulfonic acid |

Other combinations will be apparent to those skilled in the art.

In the following examples there are described several preferred embodiments to illustrate the invention. However, it is to be understood that the invention is not intended to be limited to the specific embodiments.

EXAMPLE 1

A sheet of a polyfluoroethylene polymer having sulfonic acid groups and an equivalent, weight of about 1500 and a thickness of about 300 microns is coated on one side with an electrode having electrically conductive ruthenium oxide as its active anodic component. This electrode layer is produced in the known manner by mixing together about 50 percent by weight of finely divided ruthenium-iridium oxide containing about 25% by weight of iridium, 15% by weight polyfluoroethylene (TEFLON) 25% by weight of titanium dioxide and 10% by weight of graphite. This mixture is then compressed under heat and pressure into a thin film about 0.05 to 0.1 millimeters in thickness and containing about 3 milligrams of platinum group metal oxide per square centimeter of surface area. This thin film is then bonded by heat and pressure to one side of the sulfonic acid polymer and the relative size of the respective sheets is adjusted so that the film was deposited only in a central area of the ion exchange sheet, leaving uncovered margins.

A sheet of fluorocarbon carboxylic acid cation exchange polymer having an equivalent weight of 0.5 to 4 milliequivalents per gram and a thickness of about 300 microns is coated in a central area on one side with nickel metal. The coating is deposited by soaking the polymer sheet in a reducing agent such as hydrazine and contacting the central area of the side of the soaked film with nickel salt such as nickel chloride or sulfate and the margins were shielded to prevent deposition thereupon. The result is to deposit a thin coating of nickel in a central area and to leave uncoated margins.

The two sheets are heated in 2.5 N sodium hydroxide solution at 90° C. for 16 hours. Generally, the anode layer is pressed onto the anode sheet after such heating by pressing the anode sheet onto the equilibrated membrane between pressure plates at an elevated temperature, for example 100° to 300° C. care being taken to retain electrolyte in the sheet.

The thus equilibrated sheets were superimposed with the electrodes on the outer surfaces and the assemblage is rolled while wet to squeeze out air and excess water. The laminate so formed and evacuated is placed immediately in the cell described above and in the manner described above with the nickel layer on the cathode side and the ruthenium oxide layer on the anode side. These respective electrode coatings are of such a size so that the portion of the diaphragm layers (i.e. their margins) which extend beyond the central electrolysis chamber and into the evacuation chamber 10 remain uncoated.

The cell is then clamped together so as to compress the unbonded membrane-electrode layers together and to prevent or restrain accumulation of entrapped fluid between the layers and to facilitate such squeezing, a vacuum is established in the chambers 10. Saturated aqueous sodium chloride solution is fed into the anode chamber to fill it and the catholyte chamber is filled with 30% sodium hydroxide solution. These electrolytes are circulated through their respective compartments while a voltage sufficient to establish and maintain an anode current density of 4000 amperes per square meter of anode and since the cathode area is substantially the same as that of the anode, the cathode current density is substantially the same.

The process is continued until some marked change in operation took place which is usually manifested by a rise in voltage and the cell is taken apart. Where the cathode layer had deteriorated without serious anode layer deterioration, it is replaced or repaired and the new or repaired cathode sheet is assembled with the old anode sheet for further electrolysis. Similarly, the anode sheet could be repaired or replaced and the new or repaired anode sheet assembled with the old cathode sheet for further electrolysis.

The vacuum on chamber 10 may, but generally need not, be maintained throughout the electrolysis, but the chamber is normally kept drained so that fluid accumulating between the layers could be readily squeezed out. Pressure on the layers by the clamping action of the screen is maintained throughout electrolysis and is maintained high enough to prevent substantial entrapment or accumulation of fluid between the layers and to keep the surfaces of layers in contact.

If desired, the anode may be metal such as platinum group metal in lieu of the metal oxide sheet. This metal may be deposited on the dry sheet by impregnating the sheet or one side thereof with a reducing agent such as sodium borohydride or hydrazine and then contacting one side of the sheet with a platinum group metal salt such as palladium chloride or platinum chloride. The coating may be made thicker by repeated treatments or by plating further metal, e.g. platinum, on the coating. If desired and to assist in evacuation during rolling to squeeze fluid from the layers as described above in this Example, the assembled layers may be enclosed between air tight plastic sheets or an envelope of polyethylene, polypropylene or the like during rolling. This envelope or these sheets may be used to protect and preserve the evacuation until the diaphragm is installed and they may be removed at that time.

EXAMPLE 2

The individual fluorocarbon ion exchange polymers bearing electrodes and separately swelled by heating in sodium hydroxide solution prepared as described in Example 1 are coated on the uncoated sides thereof with a water wettable polymerizable liquid containing an unsaturated polymerizable acid and a small amount, e.g. 1% by weight, of catalyst such as isopropyl peroxydicarbonate or hydrogen peroxide. The sheets so coated are rolled to exclude air and excess liquid and were pressed together between plates at room temperature until the liquid has polymerized and the sheets are cemented together to form a laminated diaphragm with electrodes on the outer sides. When hydrogen peroxide or like catalyst is used, the assembled sheets may be heated between pressure plates to 75°-100° C. to polymerize the polymerizable acid and to bond the layers together. The polymerizable liquid containing an acidic group is itself an ion exchange polymer and therefore does not provide a barrier to cation transfer or exchange.

Suitable polymerizable liquids which may be used include the following: trifluoroacrylic acid or acid fluoride, perfluoromethacrylic acid or acid fluoride, 4-vinyl-pyridine and equimolecular mixtures of styrene, maleic acid and 4-vinyl-pyridine. The assembly is installed in the cell which operated as in Example 1.

EXAMPLE 3

The sheets with electrodes on one side prepared and equilibrated by heating in alkali metal hydroxide solution as described in Example 1 are coated with an adhesive solution of a polymeric acid dissolved in water or ethanol and were assembled with the electrodes on the outside and the resulting laminate is passed through a pair of rolls to squeeze out entrapped air and excess liquid. The assembly was allowed to stand with evacuation preserved until the layers are reasonably well adhered. To assist such adhesion, the assemblies could be placed between pressure plates and heated at 100°-250° C. During standing and/or heating, some water, rarely more than about 20% of the initial amount, may evaporate. The assembled laminate is installed and was used as a diaphragm in the above described cell and electrolysis of alkali metal chloride solution is commenced.

During such operation, some or perhaps complete deterioration of the adhesive may occur, but because the layers after installation are pressed and clamped together as described above and the clamping pressure is maintained, little or no substantial layer separation took place. However, when the cell is disassembled, the layers could be separated and one replaced or repaired with the other being reinstalled for further electrolysis.

Adhesives which may be used include: polyacrylic acid, polymethacrylic acid, polymer of equal mols of styrene and acrylic acid or maleic acid anhydride or acid and a water or alcohol soluble fluorocarbon sulfonic acid polymer. Other temporary or permanent adhesives including sugar syrup also may be used. Moreover, the adhesive may be applied only around the uncoated margins, if desired.

EXAMPLE 4

A sheet of fluorocarbon ion exchange membrane having preponderantly sulfonic acid groups and provided with an electrode coating as in Example 1 is treated to establish a water content of about 5 to 20% by weight, based upon the dry weight of the sheet. This is done by heating the sheet in 10% by weight sodium hydroxide solution at 90° C. for one to 5 hours and partially drying, if necessary but it could also be accomplished by storing the sheets in an atmosphere of steam at 110° C. or in air of 100% humidity at 100° C. The anode membrane sheet thus obtained is partially swelled, i.e. about 10 to 30% of the degree to which it would swell if completely equilibrated as described in Example 1.

This anode membrane sheet is then assembled with a substantially dry, unswelled cathode membrane sheet of ion exchange having preponderantly carboxylic acid groups and coated on one side with a cathode as described in Example 1, the electrodes being on the outside of the assembly. This laminated assembly is then bonded together by pressing it between press plates or by passing the assembly through heated rolls at a temperature of 180° to 300° C. and a pressure of 50 to 510 pounds per square inch. If desired, undue water evaporation could be prevented during heating by placing the sheet in a gas tight bag of rubber or polypropylene or by enclosing the laminate between a pair of films or sheets of a non-adherent or readily removable moisture proof plastic such as polyethylene, polypropylene, cellophane etc. The thus bonded membrane electrode may be installed in the cell described above.

If desired, both electrode membrane sheets, one of which is swelled as described in this example, may be bonded together by a binder as disclosed above in Examples 2 and 3. As described above, the cell may be used to generate chlorine by electrolysis of alkali metal chloride solution containing 150 grams per liter or more of alkali metal chloride. Other halides may be similarly electrolyzed to produce the corresponding halogen. These solutions normally have a pH of 2 to 5 and thus contain some quantity of hydrogen halide such as hydrochloric acid.

The alkali metal hydroxide solution produced may range from about 150 grams of such hydroxide solution to substantial saturation by controlling the amount of water fed to the catholyte. Also alkali metal carbonates or bicarbonates may be produced by feeding alkali metal carbonate and/or carbon dioxide to the catholyte. Aqueous hydrogen chloride or other hydrogen halide may be electrolyzed in the same manner to generate the corresponding halogen. These cells and the process herein disclosed may also be used for the generation of oxygen by electrolyzing water as well as to conducting other electrolytic reactions using a liquid electrolyte.

In this specification, reference is made to ion exchange material having weak acid or strong acid groups and it will be understood that the alkali metal salts e.g. sodium salts of such acid groups may be present and the terms weak acid groups and strong acid groups are intended to include such materials, for example, the cation exchanger with carboxylic groups in the sodium form i.e. the sodium salt thereof. The advantage which occurs to a membrane electrode of two contacting separable layers is not limited to diaphragms in which the ion exchange layers are different. For many purposes such as the improvement of current efficiency, it is most advantageous to have recourse to layers with relatively strong acids on the anode side and relatively weaker acids on the cathode side. However, in some cases such as where the electrode current density is low or the alkali metal concentration is relatively low, the composition of the layers may be the same particularly since either the anode membrane layer or the cathode membrane layer may be replaced as the electrode thereon deteriorates and cell operation is continued with the replaced membrane electrode layer and the older membrane electrode layer which exhibits longer life and greater durability.

According to a further embodiment, the electrodes bonded to or coated on the membrane layer may be dispensed with and the screen current distributors used as the electrodes. Furthermore, one of the layers e.g. the cathode layer may have the cathode bonded thereto while the layer adjacent in the anode compartment may be uncoated with the anode being a valve metal screen or expanded metal sheet coated with a platinum group metal oxide pressed against the anode side of the multilayer diaphragm.

Although the present invention has been described with reference to specific details of certain embodiments thereof, it is not intended that such details should be regarded as limitations to the scope of the invention except insofaras included in the accompanying claims.

What we claim is:

1. An electrolytic cell having a diaphragm dividing a cell unit into anodic and cathodic compartments with an anode in the anode compartment and a cathode in the cathode compartment, said diaphragm comprising at least two separable layers of ion permeable, fluid tight materials, said layers being in contact with each other with the zone of said contact being evacuated.

2. The cell of claim 1 wherein means are provided to evacuate the space between the layers.

3. The cell of claim 1 wherein the anode and cathode are in contact with opposite sides of the diaphragm and means are provided to press the electrodes and layers together.

4. The cell of claim 1 wherein the layer adjacent the anode side is more strongly acidic than the layer more close to the cathode.

5. The cell of claim 4 wherein both layers have electrodes bonded to the outer surfaces thereof.

6. The cell of claim 1 wherein a gas and electrolyte permeable electrode is bonded to the outer side of the layers.

7. An electrolytic cell having a diaphragm dividing a cell unit into anodic and cathodic compartments with an anode in the anode compartment and a cathode in the cathode compartment, said diaphragm comprising at least two layers of ion permeable, electrolyte swellable ion exchange material, said layers being in contact with each other and having been at least partially swelled separately and means to press the layers together during cell operation.

8. The cell of claim 1 or 7 wherein the layers are cation exchange polymers.

9. The cell of claim 7 wherein the layers are held together in separable contact.

10. The cell of claims 1 or 7 wherein means are provided to establish a differential pressure between the contacting sides of the layers and an edge of said contacting layers.

11. The cell of claims 1 or 7 wherein the layers are different cation exchange materials.

12. The cell of claim 1 or 7 wherein the layers do not permit mass flow of electrolyte therethrough.

13. The cell of claim 1 or 7 wherein the anode and cathode are in contact with opposite sides of the diaphragm.

14. An electrolytic cell having a diaphragm dividing a cell area into separate compartments, said diaphragm comprising at least two layers which are comprised of different ion permeable, swellable materials bonded together, at least one of said bonded layers having been at least partially preswelled before bonding.

15. The cell of claim 14 wherein both of said layers have been preswelled before bonding.

16. The method of claim 14 wherein the layers are different cation exchange materials.

17. The method of claim 16 wherein the layers do not permit mass flow of electrolyte therethrough.

18. A method of generating halogen which comprises electrolyzing an aqueous halide solution in an electrolytic cell having a diaphragm comprising a multi-layered ion exchange membrane dividing the cell into anode and cathode compartments with anode and cathode respectively therein, said membrane having two fluid tight membrane layers in contact with each other, evacuating between said layers to hold them in contact and maintaining an electrolyzing potential between the anode and cathode while circulating aqueous halide solution in contact with the anode.

19. The method of claim 18 wherein the space between the layers is evacuated.

20. The method of claim 19 wherein electrolyte pressure on opposite sides of the diaphragm is higher than the pressure between the layers.

21. A method of generating halogen which comprises electrolyzing an aqueous halide solution in an electrolytic cell having a diaphragm comprising a multi-layered ion exchange membrane dividing the cell into anode and cathode compartments, said membrane having two swellable layers in direct contact with each other and said layers being separately swelled, maintaining an electrolyzing potential between the anode and cathode while circulating aqueous halide solution in contact with the anode and maintaining pressure on the layers to press them together.

22. The method of claims 18 or 21 wherein the layer on the anode side is more strongly acidic than the layer on the cathode side of the first named layer.

23. The method of claims 18 or 21 wherein the layer are different cation exchange materials.

24. The method of claim 21 wherein the layers are bonded together, at least one of said layers having been preswelled prior to said bonding.

25. A method of conducting an electrolytic reaction in a cell having an anode and cathode with an ion permeable diaphragm comprised of a pair of separable ion exchange layers pressed into contact with each other and separating the anode from the cathode, at least one of said layers having an electrode bonded to the outer side thereof, continuing said operation until one of said layers or the electrode thereon has deteriorated, separating the deteriorated layer and replacing it with another layer and continuing operation while pressing the replaced layer against the other older layer.

26. The method of claim 25 wherein the layers are made of cation exchange material and chlorine is generated by circulating an aqueous chloride in contact with the anode and maintaining an electrolyzing potential between the anode and cathode.

27. The method of claims 25 or 26 wherein both the anode and cathode are bonded respectively to the outer sides of the contacting layers thereby providing an anode diaphragm layer pressed against a cathode membrane layer and one of said layers is restored and electrolysis continued with the older layer and the restored layer pressed together.

* * * * *

UNITED STATES PATENT AND TRADEMARK OFFICE

CERTIFICATE OF CORRECTION

PATENT NO. : 4,331,521

DATED : May 25, 1982

INVENTOR(S) : RAYMOND S. CHISHOLM ET AL.

It is certified that error appears in the above—identified patent and that said Letters Patent is hereby corrected as shown below:

Column 1, line 40: "to anode" should be -- of anode --.

Column 8, last line: Delete the comma ",".

Column 10, line 39: "perox-" should be -- peroxy- --.

Column 10, line 40: "ydicarbonate" should be -- dicarbonate --.

Signed and Sealed this

*Seventeenth* Day of *August 1982*

[SEAL]

*Attest:*

GERALD J. MOSSINGHOFF

*Attesting Officer*

*Commissioner of Patents and Trademarks*